US005964171A

United States Patent [19]

Ciucani

[11] Patent Number: 5,964,171

[45] Date of Patent: Oct. 12, 1999

[54] METHOD FOR SEWING VARIOUS KINDS OF ARTICLES, IN PARTICULAR MADE OF LEATHER, AND MACHINE FOR CARRYING OUT THIS METHOD

[76] Inventor: Mario Ciucani, C.da S. Girolamo 13, 63023 - Fermo (Ascoli Piceno), Italy

[21] Appl. No.: 09/000,143

[22] PCT Filed: Jul. 30, 1996

[86] PCT No.: PCT/IB96/00760

§ 371 Date: Feb. 2, 1998

§ 102(e) Date: Feb. 2, 1998

[87] PCT Pub. No.: WO97/05316

PCT Pub. Date: Feb. 13, 1997

[30] Foreign Application Priority Data

Aug. 1, 1995 [IT] Italy ..... BO95A0392

[51] Int. Cl.[6] ..... D05B 15/02; D05B 31/00; D05B 27/10

[52] U.S. Cl. ..... 112/475.08; 112/62; 112/322; 112/260

[58] Field of Search ..... 112/475.08, 475.04, 112/475.01, 47, 51, 60, 61, 62, 29, 35, 39, 260, 235

[56] References Cited

U.S. PATENT DOCUMENTS

| | | | |
|---|---|---|---|
| 1,672,707 | 6/1928 | Burrier | 112/62 |
| 2,105,097 | 1/1938 | Poole | 112/47 |
| 3,080,836 | 3/1963 | Clemens et al. | 112/47 |
| 4,848,252 | 7/1989 | Ciucani | 112/49 |
| 5,083,518 | 1/1992 | Ciucani | 112/62 |
| 5,228,162 | 7/1993 | Wu | 112/258 |

FOREIGN PATENT DOCUMENTS

| | | |
|---|---|---|
| 323411 | 7/1989 | European Pat. Off. . |
| 487820 | 11/1929 | Germany . |

*Primary Examiner*—Ismael Izaguirre
*Attorney, Agent, or Firm*—Oblon, Spivak, McClelland, Maier & Neustadt, P.C.

[57] ABSTRACT

A method for sewing leather articles includes positioning one edge of a first article (8) and one edge of a second article (9) to be sewn together against respective flat side surfaces (*7a*,*7b*) of a longitudinal guiding plate (7) formed at the top of a ring-like block (11). The ring-like block (11) rotates on a pin (12) that is supported, with horizontal axis and perpendicular to said guiding plate (7), by a free end of an arm (13) that swings with respect to a stationary support frame (2). The edges of the articles (8,9) are sewn together by means of an arc-shaped needle (6), which is reciprocated on a plane transversal to the guiding plate (7), between a retracted position, in which the needle is located beside one of said flat side surfaces (*7b*) and a piercing position, in which the needle pierces said articles (8,9); the needle (6) is moved forward and backward according to a predetermined step. Sewing of said articles (8,9) is followed by swinging said arm (13) together so that spatial attitude of the guiding plate (7) is kept unchanged as the sewing progresses.

10 Claims, 10 Drawing Sheets

FIG. 5
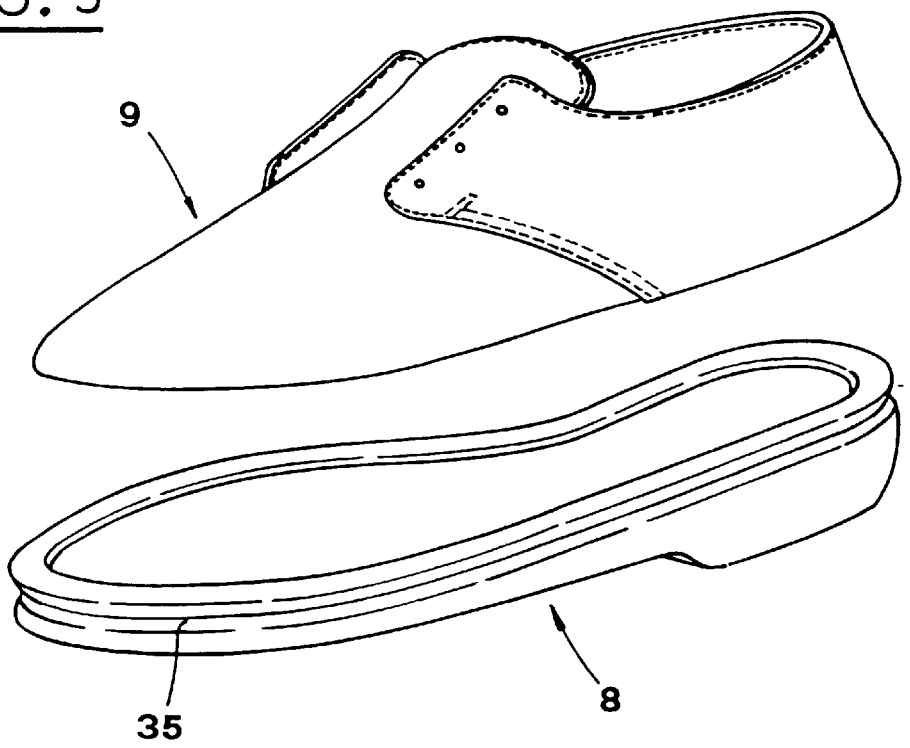
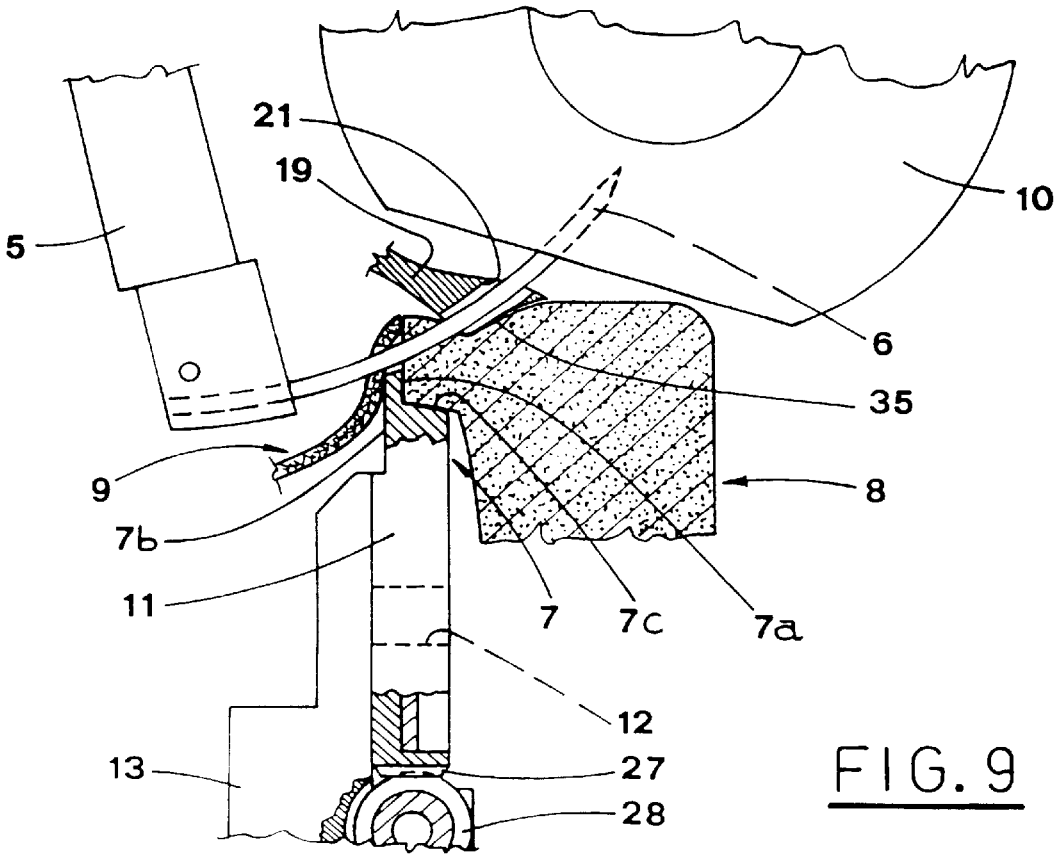
FIG. 9

METHOD FOR SEWING VARIOUS KINDS OF ARTICLES, IN PARTICULAR MADE OF LEATHER, AND MACHINE FOR CARRYING OUT THIS METHOD

TECHNICAL FIELD

The present invention concerns sewing articles made of leather and the like, in particular for footwear production.

BACKGROUND ART

Known automatic machines for sewing leather articles usually feature a head, cantilevered on the front of the base structure and equipped with means for supporting the needle and related operating means.

The needle is moved toward an arm, which is situated below, that acts as a horizontal support, on which the leather articles to be sewn rest. The needle moves also in a direction parallel to the support arm.

The above mentioned machines are equipped also with transport means that move the two edges of leather articles to be sewn positioned one over the other, after each stitch.

A machine of this type is disclosed in the U.S. Pat. No. 4,848,252 by Applicant. This machine features a guide with two longitudinal flat surfaces, upwardly convergent, that form respective work tops, on which the leather articles to be sewn are moved.

Over the guide, there is provided a longitudinal shaft, with an arm keyed thereto and provided at its free extremity with an arc-like needle. The shaft oscillates so as to alternatively move the needle between a raised position and a lowered position, in order to pierce the edges of the leather articles. The needle operates in combination with a rotary hook with a thread.

The above mentioned machine sews edges of two leather articles, e.g. shoe uppers and toe caps.

However, this machine cannot be used for sewing together the bottom and the upper, in case the shoe is of open type and a strip is to be joined to the bottom.

FIG. 12 shows, as an example, a shoe with an upper sewn along its edge to a bottom.

It is to be noted that in this case the sewing is visible both along the edge of the upper and along the edge of the bottom, thus forming a kind of decorative motif.

At present, the sewing of the bottom to the upper is often hand-made, that requires a specialized staff thus increasing manpower cost and subsequently, the final cost of the product, and moreover, the productivity is reduced.

Another problem deriving from the hand-made sewing lies in the necessity of a camber that is made in front part of the shoe by previously shaping the front part of the upper like a dome.

Other known automatic machines, so-called "Rapid", can sew the bottom to the shoe upper.

However, the use of these machines requires former joining of the bottom and the upper by means of glue; moreover, the shoe must be mounted on a suitable last during sewing.

Obviously, this results in considerable working complexity and consequently, affects the cost of the product and the productivity.

DISCLOSURE OF THE INVENTION

The object of the present invention is to provide a method for simplified sewing of leather articles, in particular the bottom and the upper of a shoe, without preliminary operations.

Another object of the present invention is to provide a machine that carries out the above mentioned method of sewing and that has a simple structure and is versatile in relation to different kinds of footwear.

The above mentioned objects are obtained in accordance with the invention by means of a method for sewing various kinds of articles, in particular made of leather, that includes:

positioning one edge of a first article and one edge of a second article to be sewn together against respective flat side surfaces of a longitudinal guiding plate formed at the top of a ring-like block, which rotates on a pin that is supported, with a horizontal axis and perpendicular to said guiding plate, by a free end of an arm that swings with respect to a stationary support frame; sewing said edges of said articles together by means of an arc-shaped needle that is reciprocated on a plane transversal to said guiding plate, between a retracted position, in which the needle is located beside one of said flat side surfaces and a piercing position, in which the needle pierces said articles, said needle being moved forward and backward according to a predetermined step; swinging said arm while sewing the two articles together so that the spatial attitude of said guiding plate is kept unchanged as the sewing progresses.

The method is carried out by a machine that includes:

one longitudinal guiding plate, which defines two opposite flat side surfaces against which said articles are positioned while being moved forward, said guiding plate featuring a shoulder for abutment thereon of said first articles;

an arc-like needle, which reciprocates on a plane that is transversal to said guiding plate between a retracted position, in which the needle is located beside one of said flat side surfaces and a piercing position, in which the needle pierces said articles, said needle being moved forward and backward according to a predetermined step;

a rotary hook assembly and a thread spool located beside the other one of said flat side surfaces for cooperation with said needle to form the stitches; means movable in a direction transversal to said guiding plate to abut on and clamp said articles during needle piercing and retraction respectively;

a ring-like block, whose top carries said guiding plate, that is rotatably supported by a horizontal pin transversal to said guiding plate and fastened to a free end of an oscillating arm, which swings with respect to a stationary frame;

a device for keeping the spatial attitude of said guiding plate unchanged when said oscillating arm swings.

BRIEF DESCRIPTION OF THE DRAWINGS

The characteristics of the invention will be better understood from the following description, with particular reference to the attached drawings, in which:

FIG. 5 is a perspective view of the bottom and the upper of a shoe to be sewn by the subject machine;

FIG. 9 is a vertical section view of a detail of the above mentioned stitching zone;

BEST MODE OF CARRYING OUT THE INVENTION

Figure 1:
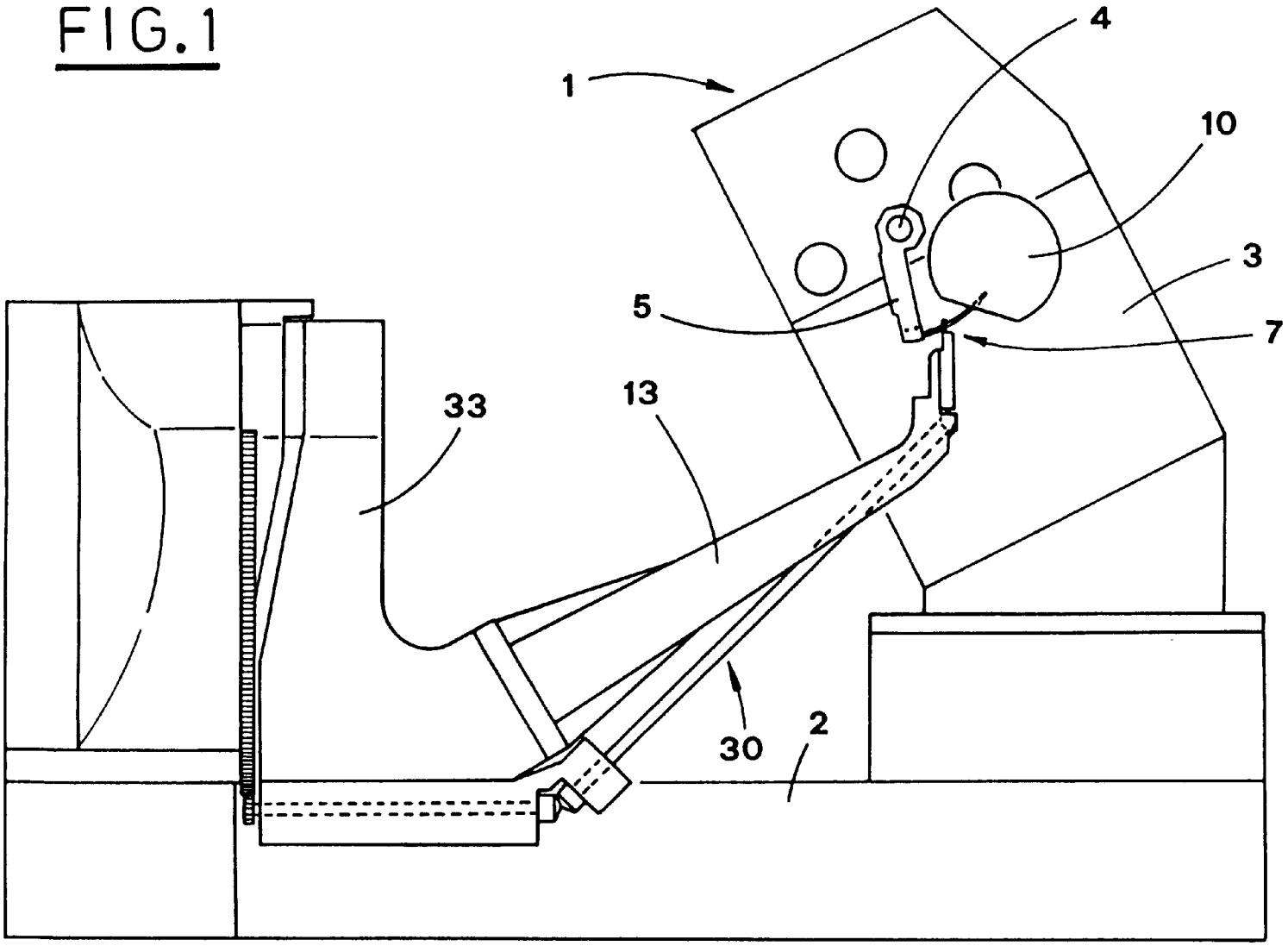
FIG. 1 is a front view of the present machine for sewing leather articles.
Figure 2:
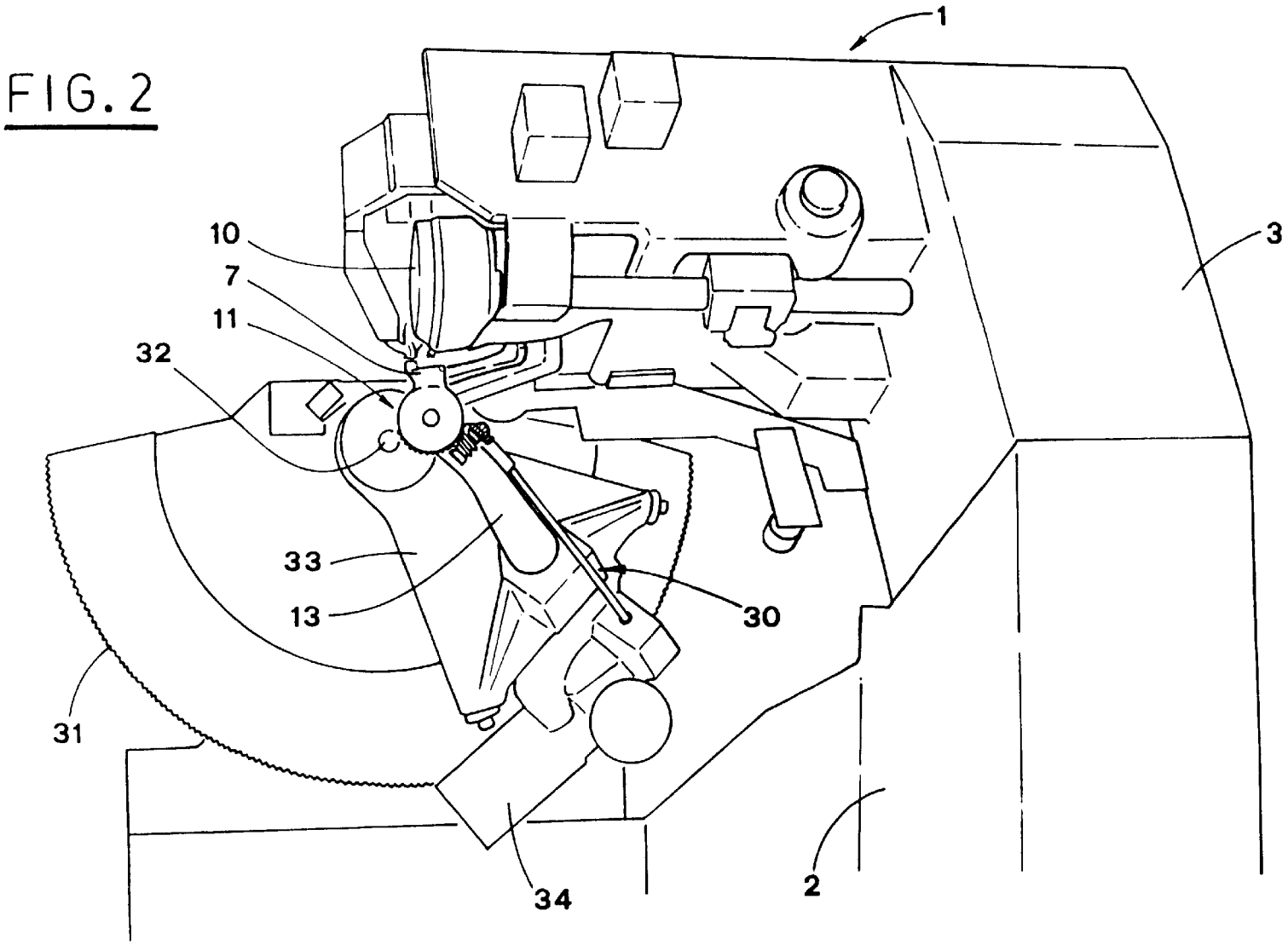
FIG. 2 is a partial side view of the same machine.
Figure 4:
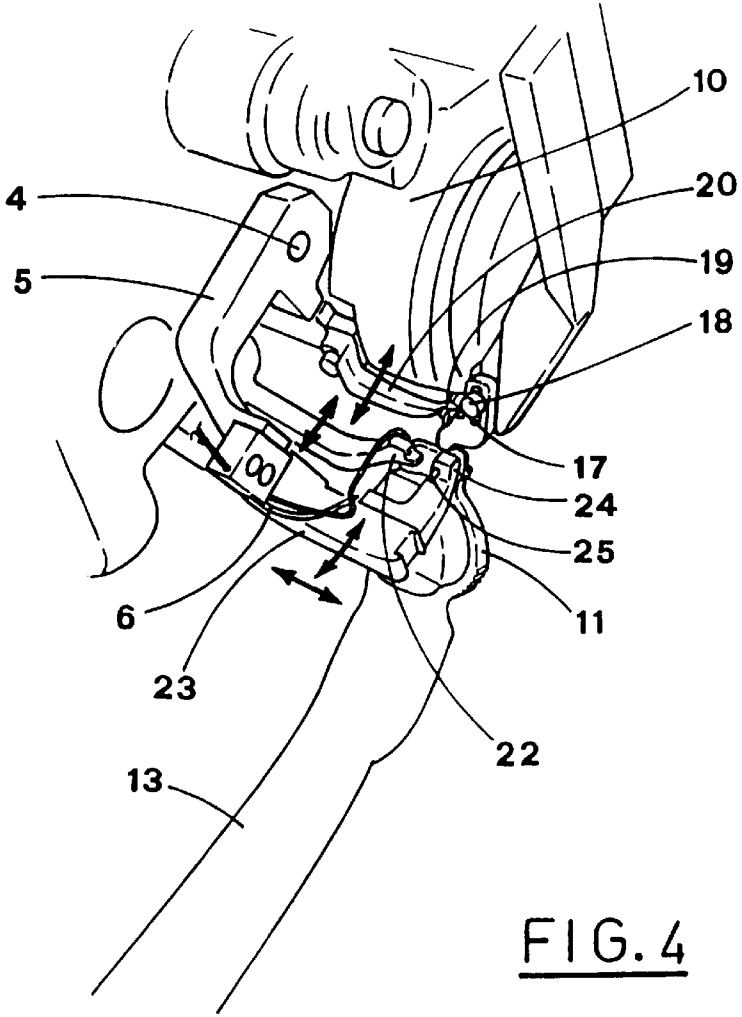
FIGS. 3 and 4 are perspective views of the stitching zone of the machine being the subject of the present invention, seen at different angles.

With reference to the above mentioned figures, numeral 1 indicates the head of the sewing machine, that carries means for operating sewing means.

The head 1 is an integral part of a stationary support frame 2 of the machine; in particular, the head 1 is cantilevered on the front of a body 3 of the frame 2, whose axis is suitably inclined with respect to the vertical.

The head 1 supports, in a known manner, a longitudinally oriented shaft 4 provided with a transversal arm 5. A curved needle 6 is tangentially mounted on an end of the transversal arm 5 and extends along a virtual circumference that is concentric with the shaft 4.

The needle 6 oscillates between a retracted position, beside the work plans of the guiding plate 7, as specified in the following, and a piercing position, in which the needle 6 passes through the articles 8 and 9 to be sewn.

These articles 8 and 9 in particular include the bottom and upper of a shoe. The needle 6 oscillates in a suitable phase relation with the advancement movement of the leather article to be sewn.

The shaft 4 of the needle 6 is reciprocated axially so at to move forward and backward according to a predetermined step, and impart a forwarding motion to the articles 8,9 to be sewn.

A rotary hook 10, with a thread spool, works in cooperation with the needle 6. The rotary hook 10 is situated beside the work plans of the guiding plate 7 on the side opposite to the side where the needle rests when in retracted position.

As seen in detail in FIG. 9, the guiding plate 7 is laterally delimited by flat surfaces 7*a*,7*b*, which are substantially vertical.

The flat surfaces 7*a*,7*b* form respective working plans for positioning and guiding the articles 8 and 9 to be sewn.

Below the working plan 7*a*, the guiding plate 7 forms a shoulder 7*c* for abutment thereon of the internal edge of the article 8.

The guiding plate 7 is formed at the top of a ring-like block 11, which rotates on a pin 12 with horizontal axis. The pin is supported by a free end of an arm 13 that swings with respect to a stationary support frame 2.

A rim presser 14, is situated over the guiding plate 7, for pressing the edge of the articles to be sewn by means of a shaped head 15.

The position of the rim presser 14 is vertically adjustable because it is fixed by means of a locking member 18 that passes through a vertical slot 17 made. Releasing the locking member 18 and displacing the rim presser 14 makes it possible to change the height of the articles 8,9 over the guiding plate 7 and consequently, the position of the sewing line with respect to the edges of the articles.

According to a constructive variation, not shown, the head 15 of the rim presser 14 includes two elements, drawn close one to the other, that act respectively in the regions of the edges of the articles 8,9 and that can be adjusted independently so as to regulate the mutual position of the articles 8,9.

In the shown example, the rim presser 14 remains stationary in the pre-fixed position, but it is possible for the rim presser 14 to be vertically displaced for particular working needs, e.g. introduction and withdrawing the articles 8, 9 to be sewn.

A presser foot 19 is formed at the end of an arm 20 and is situated beside the working plan 7*a* of the guiding plate 7.

The arm 20 is moved, by known means, in direction transversal to the stitching line being formed and longitudinal to the same line in synchrony with the needle 6 movement direction; the foot 19 has a through hole 21, through which the needle 6 passes freely.

During piercing motion of the needle 6, the foot 19 rests against the bottom 8 to hold it.

A leather pressing element 22, situated beside the working plan 7*b*, moves in direction transversel to the stitching line being formed and keeps the articles 8,9 after each stitch has been performed, when the needle 6 is being withdrawn.

A crumpling group 23, also situated beside the working plan 7*b*, reciprocates backward and forward in direction longitudinal to the guiding plate 7 and in direction transversal thereto.

The group 23 supports a head 24, equipped with a transversal peg 25 that engages the article 9, i.e. the shoe upper, so as to crumple the edge of the same upper being sewn, as it will be described in the following.

The ring-like block 11 is a part of a device 26 that keeps unchanged the spatial attitude of the guiding plate 7.

A device of this type is described in a detailed way in the Italian Utility Model No. 0216423 of the same Applicant.

Figure 3:
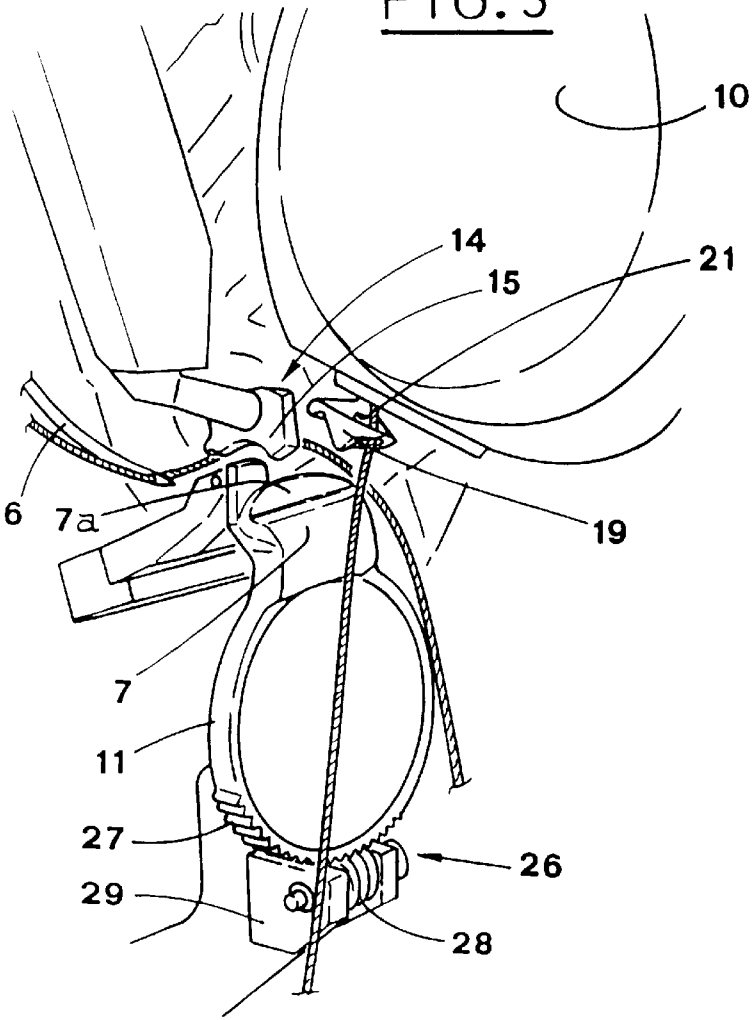

In particular, the lower part of the circumferential surface of the ring-like block 11 features a toothing 27 that engages with a horizontal worm screw 28, which is supported below the said ring-like block 11 by a couple of plates 29, integral with the arm 13 (FIG. 3).

The worm screw 28 is joined to motion transmission means 30 that operate a gear, not shown in the drawing, engaging with a sector of a ring gear 31 that is integral with the stationary support frame 2, on a vertical plan, parallel to the above mentioned working plans of the guiding plate 7.

This toothed section ring gear is coaxial with a pivot 32, on which an oscillating support 33 of the arm 13 rotates operated by a motor 34, e.g. commanded by means of pedals or the like.

The operation of the described machine will now be illustrated beginning from introduction of the articles to be sewn, in this particular case the bottom 8 and the upper 9 of a shoe; the upper 9 is of open type, i.e. is formed by a strip to be joined with the bottom 8 along an edge (FIG. 5).

Figure 6:
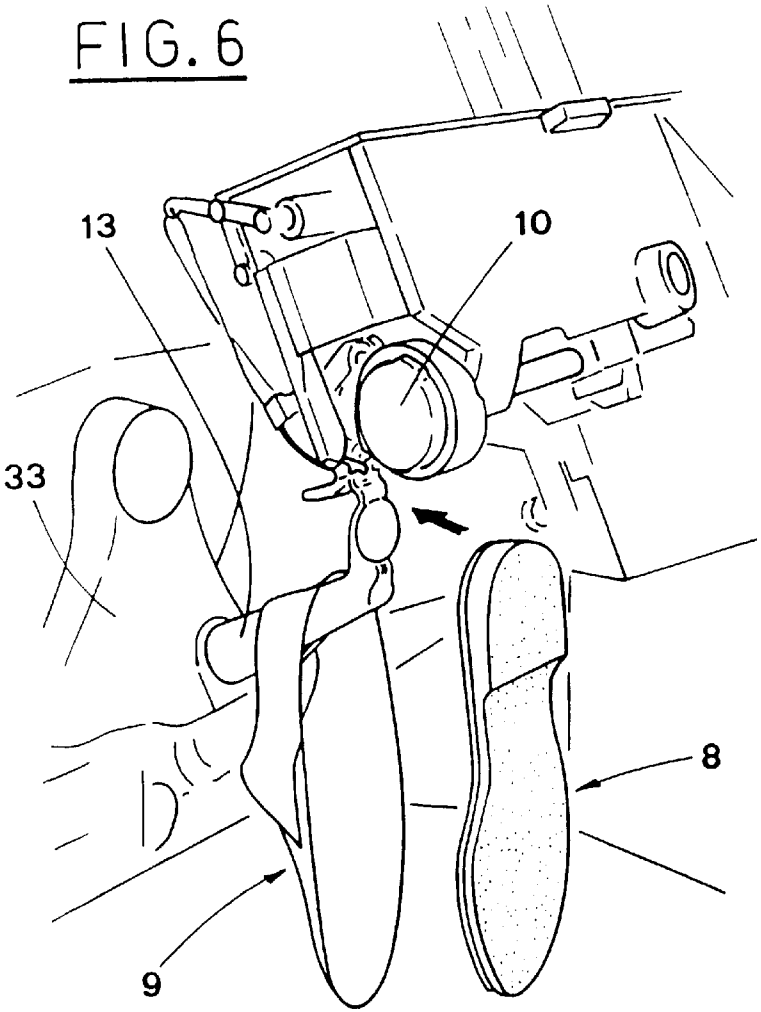
FIG. 6 is a perspective view of the whole above mentioned stitching zone, during introduction of the articles to be sewn.

The upper 9 is placed on the arm 13 supporting the ring-like block 11 (FIG. 6). In this way it is possible to position the edges of the bottom 8 and of the upper 9 each one against a respective working plan 7*a*,7*b* of the guiding plate 7.

In order to facilitate the articles introduction, the arm 13 carrying the ring-like block 11 can be lowered, e.g. by rotating the support 33 by suitable actuator means. Otherwise, already mentioned, it is possible to raise the rim presser 14.

Figure 7:
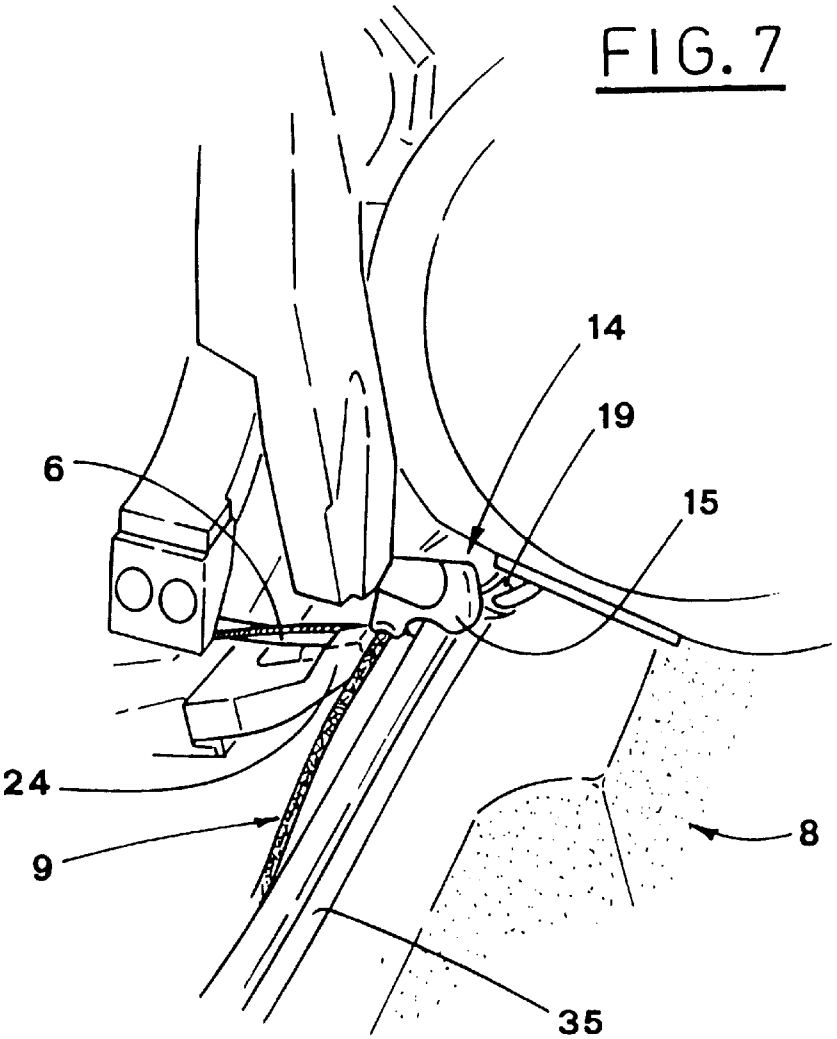
FIG. 7 is a detailed view of the stitching zone of the machine, during working step, as viewed substantially at the same angle as FIG. 3.

In the working position, the rim presser 14 abuts on the upper part of the edges of the bottom 8 and the upper 9 (FIG. 7).

In this arrangement, rotation of the needle 6 to the piercing position performs, in conjunction with the action of the rotary hook 10, a stitch on the above mentioned edges of the bottom 8 and the upper 9.

Figure 8B:
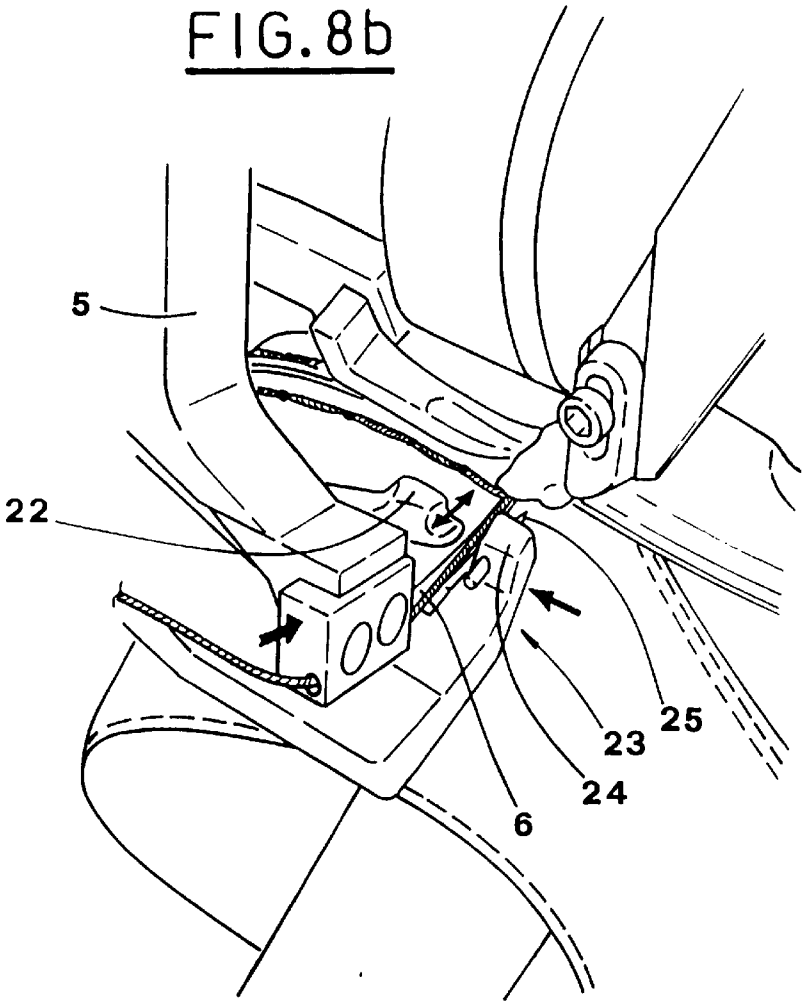
FIGS. 8*a* and 8*b* are respectively, perspective views of the stitching zone, seen at the same angle as in FIG. 4, in subsequent working steps.
Figure 8A:
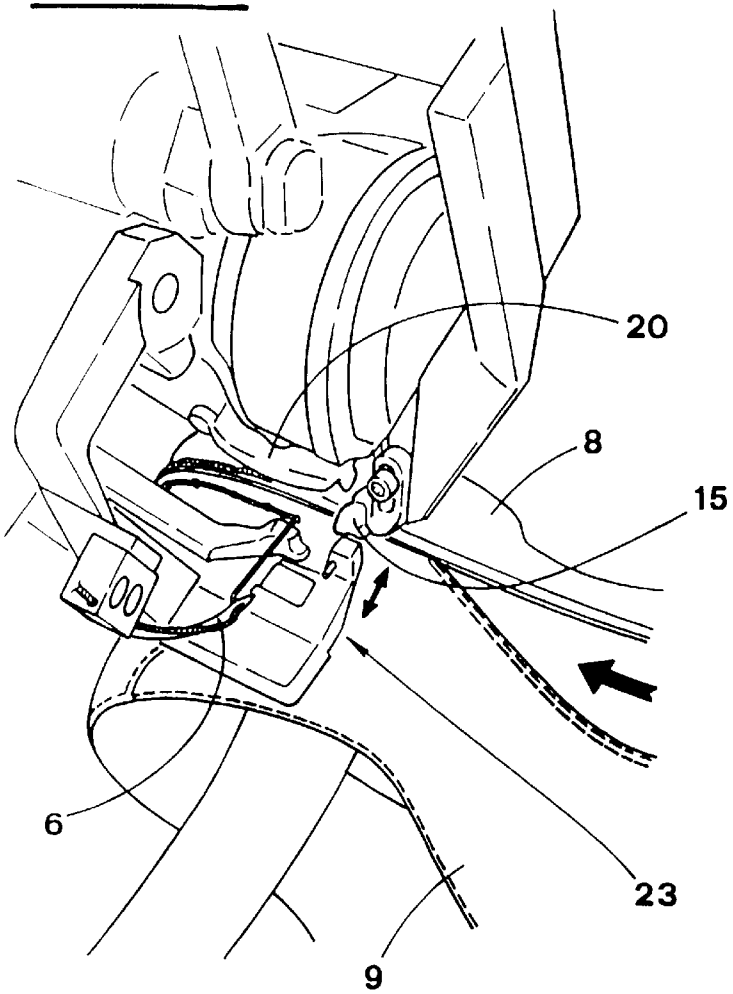

The needle 6 follows a circular path (FIG. 8*a*). After having passed through the edges of the bottom 8 and the upper 9, the needle 6 reaches the working zone of the rotary hook 10 (FIG. 8*b*). In this region the loop formed in the thread of the needle 6 is hooked, due to the oscillation of the rotary hook 10, in a known manner.

It is to be noted that, during the needle 6 piercing movement, the presser foot 19 engages the upper part of the peripheral groove 35 of the bottom 8, so as to abut on the same bottom 8 and, indirectly, on the upper 9 (FIG. 9), the needle 6 passes through the hole 21 of the foot 19.

After the needle 6 has passed through the edges of the bottom 8 and the upper 9, the articles 8, 9 are moved forward on the guiding plate 7.

In fact, this movement is determined by the longitudinal translation of the needle 6, which makes the articles 8,9 slide on the guiding plate 7.

When the longitudinal translation has been completed, the leather pressing element 22 is imparted with an oscillation on a plane transversal to the guiding plate 7 so as to clamp the edge of the upper 9 to the guiding plate, in a position adjacent to the just made stitch. In this manner also the bottom 8 is locked (see again FIG. 8*b*).

This allows to keep the stitched zone of the articles 8 and 9, when the needle 6 rises, so that the thread hooked by the rotary hook 10 forms the loop.

At this point, the needle 6 together with the rotary hook 10 are longitudinally translated in a direction opposite to the forward movement direction of the articles 8, 9, so that the initial conditions are restored, in order to perform next stitch.

During the return stroke of the needle 6, the bottom 8 and the upper 9 are kept firmly by the leather pressing element 22.

Figure 10:
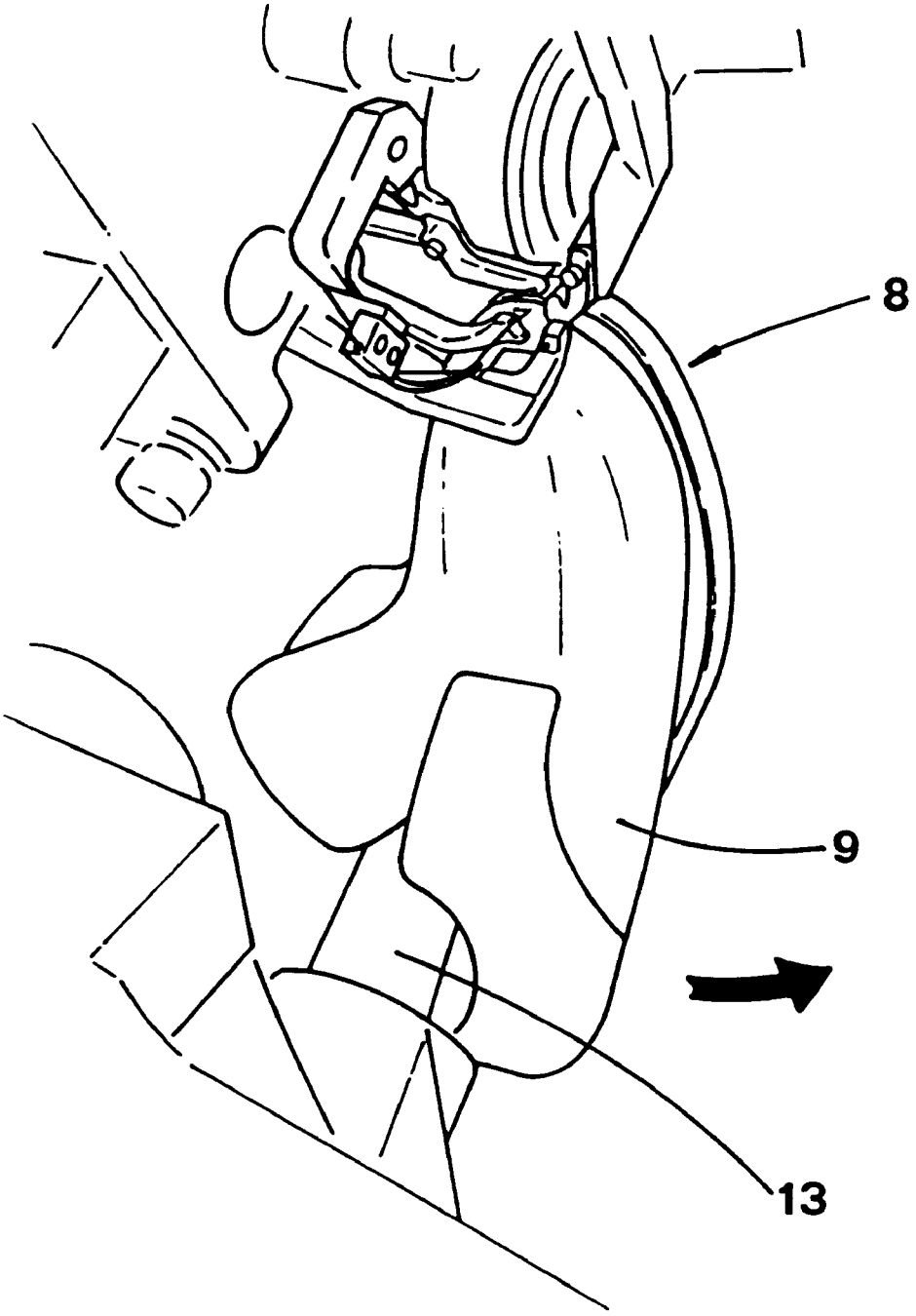
FIGS. 10 and 11 are further perspective views, seen at different angles, of the machine stitching zone in subsequent working steps.

Stitching advancement, determined by the forwarding action of the needle 6 on the articles 8 and 9, is followed by the operator who suitably rotates the shoe so as to guide the edges of the articles 8,9 along the stitching path defined by the guiding plate 7 (FIG. 10) and by the rim presser 14.

Figure 11:
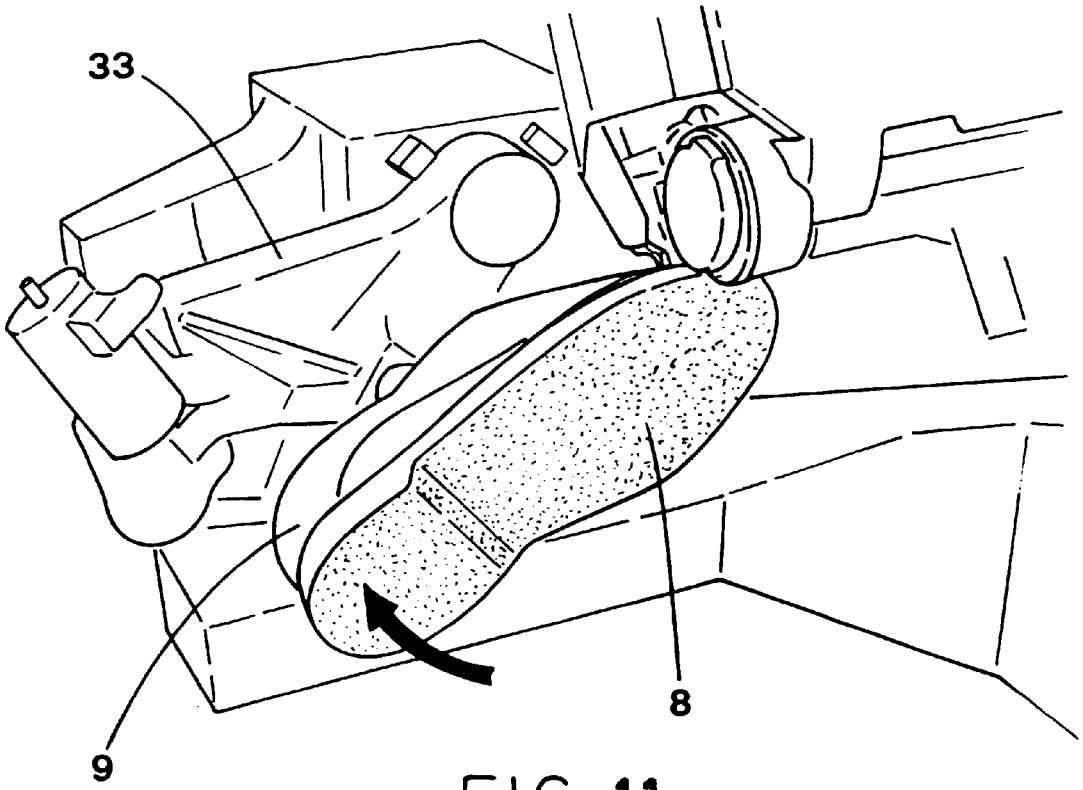

The same operator rotates the oscillating support 33 of the arm 13 on the pivot 32 in one direction or another to prevent the arm 13 from interfering with shoe rotation while sewing (FIG. 11) is performed.

It is to be pointed out that the oscillation of the support 33 and the arm 13 does not affect the ring-like block 11 position and consequently the guiding plate 7 position remains unchanged, since the effect of the rotation of the same support 33 on the pivot 32 is completely eliminated by counter-rotation imparted to the same ring-like block 11 by the device 26.

In fact, any rotation of the support 33 is transmitted to the worm screw 28 by the motion transmission means 30 that engage the ring gear 31; analogously, the worm screw 28 rotates axially in one direction or another, according to the rotation of the support 3, causing the above mentioned counter-rotation of the ring-like block 11, engaged with the same worm screw 8 by means of the toothing 27.

Therefore, in the arrangement provided for sewing, the spatial attitude of the guiding plate 7 remains unchanged.

The operator can also activate the group 23 that allows to perform crumpling of a sewing edge, in particular that of the upper 9.

This crumpling is provided in the regions of the shoe tip and heel and, in particular includes increase of the movement of the upper 9 leather with respect to the bottom 8, so as to compensate for bigger peripheral length of the same upper.

A spontaneous bulge of the upper, in correspondence with the tip, is obtained by the above mentioned procedure avoiding the usual camber making operation, already mentioned before.

Crumpling beginning and end points, whose value may be changed by means, which are not shown, included in known way in the head 1 of the sewing machine, are marked on the upper by the usual working procedure.

When the crumpling group 23 is activated, it moves first in direction transverse to the guiding plate, so as to bring the head 24, fitted with a transversal peg engaged with the upper 9 (FIG. 8*a*) and then in longitudinal direction so as to determine crumpling of the upper edge.

The crumpled edge of the upper 9 remains clamped between the head 24 and the guiding plate 7 until the needle 6 is operated to perform next stitch.

Figure 13:
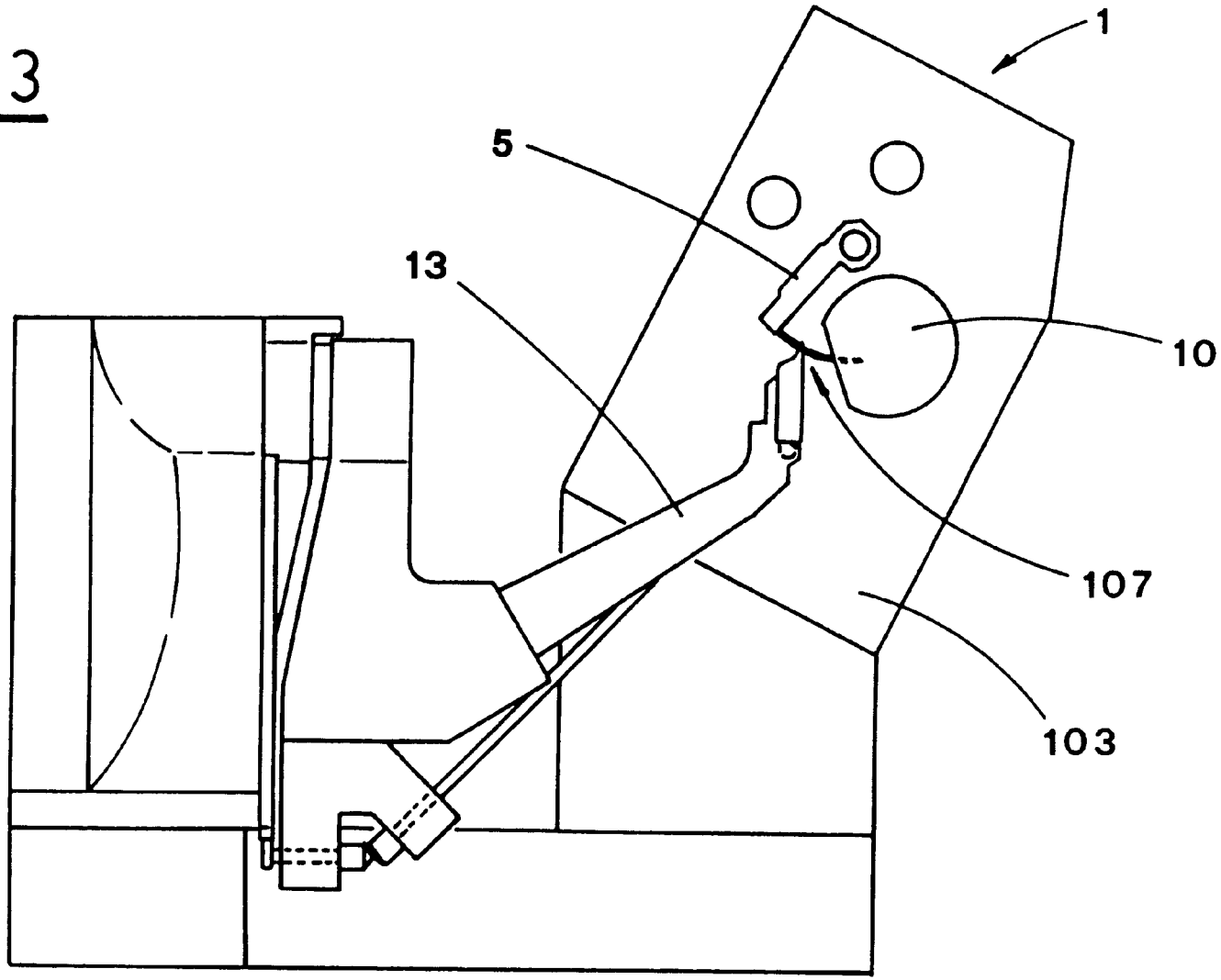
FIGS. 13 and 14 are views corresponding to FIGS. 1 and 9 for a variation of the machine.
Figure 14:
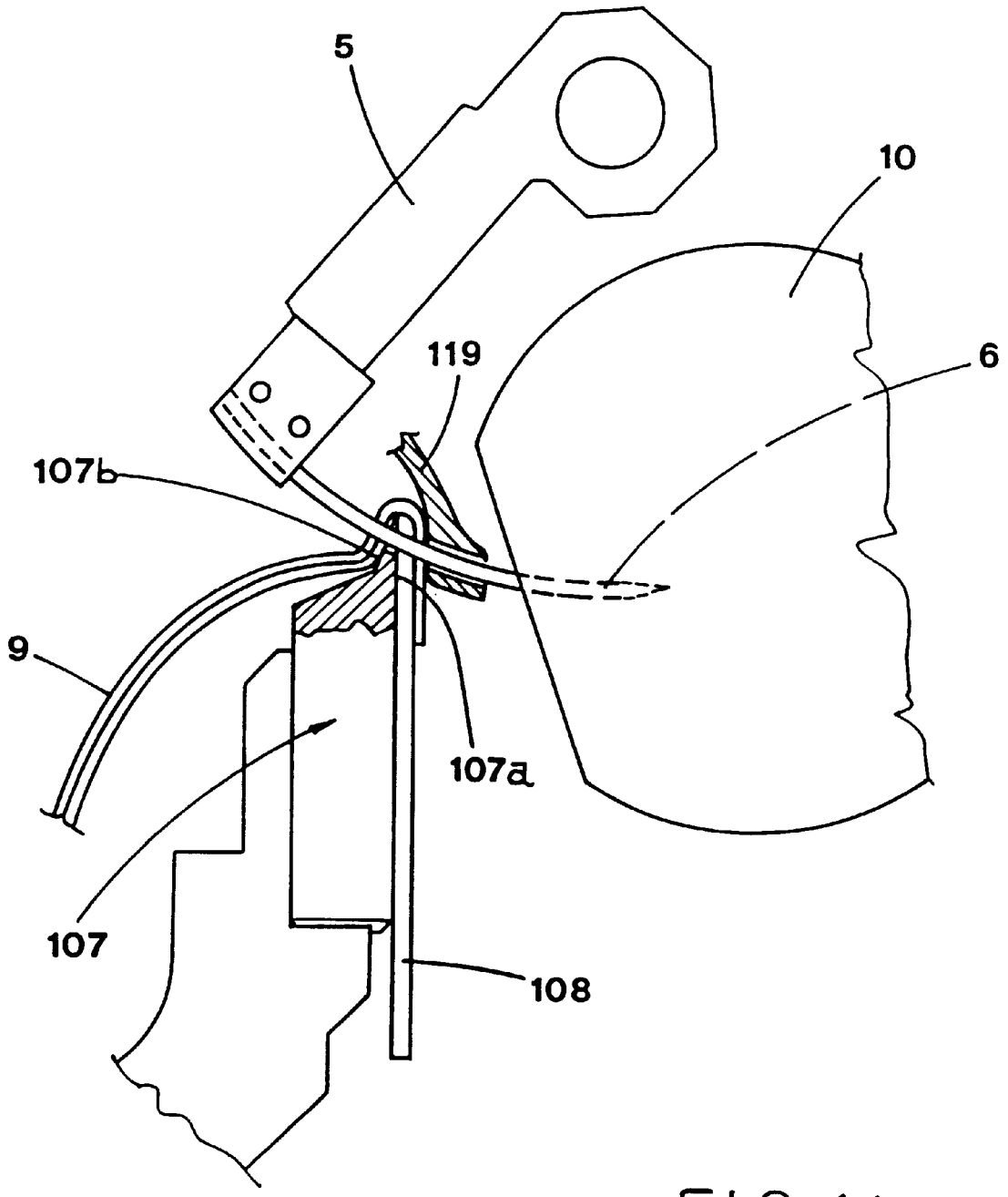

FIGS. 13 and 14 show respective views of the machine modified according to a variation. In this modified version, the head 1 is inclined in a direction opposite with respect to that of FIG. 1.

To obtain this configuration, the support body 103 is in fact rotated over a 180 degree angle.

The result is that the needle moves along a virtual circumference in downward direction, instead of an upward direction as for the embodiment of FIG. 1.

In particular, taking into consideration the above mentioned circumference, while the needle of FIG. 1 runs along an arc extending from about 270 degree on, the needle of FIG. 13 runs along an arc extending from about 225 degree on.

The guiding plate 107 must be shaped so as to allow the needle to work along a path different from that of FIG. 1. In particular, the inclined working plan 107*b* that receives the upper 9 of the shoe is situated on a side of the guiding plate 107 where the needle enters the articles to be sewn.

On the contrary, a flat working plan 107*a*, receiving a pre-sole 108, is situated on the side where the needle exits, while going downwards. Also the presser foot 119 must match the different shape of the guiding plate 107 and allow the needle to move along a different path.

This variation is suitable for carrying out the so called St. Crispino or Ideal seams for particular kinds of shoes.

The above described machine, acting according to the subject method, allows to automatically perform stitching of leather articles like the bottom and the upper of footwear.

In particular, this operation does not need previous gluing of the edges to be sewn and mounting of the shoe on a suitable last during the sewing step.

Figure 12:
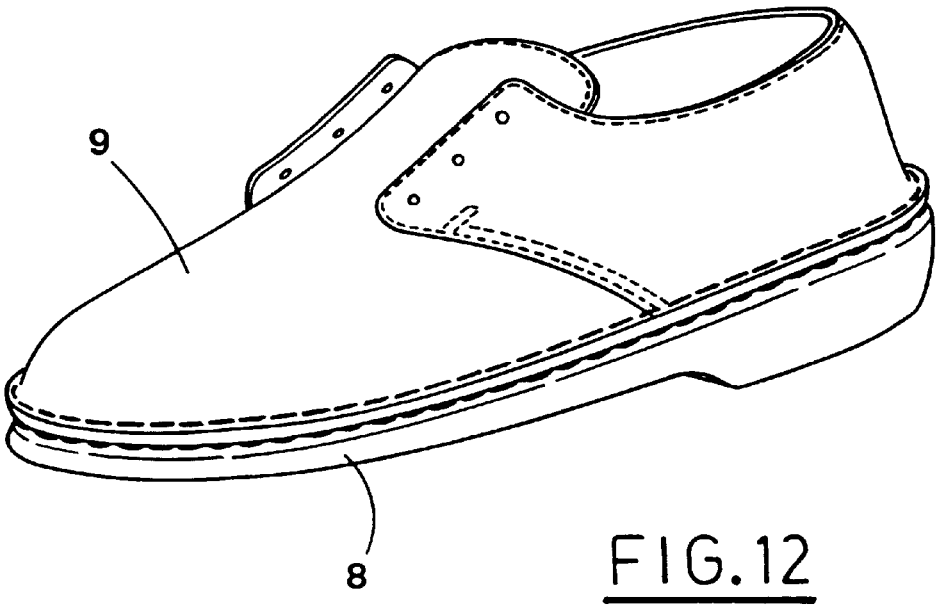
FIG. 12 is a perspective view of a shoe sewn according to the present method.

The machine allows to produce footwear of the type illustrated in FIG. 12, in which the sewing is seen both along the upper 9 edge and along the bottom 8 edge.

It is possible to flesh the upper 9 edge at a suitable angle, in correspondence with the joining surface facing with the bottom 8, so as to delimit a suitable angle between the stitches of the upper 9 sewing line and the stitches of the bottom 8 sewing line, suitably aligned along the groove 35.

The structure of the machine allows to vary the above mentioned angle, of the appropriate value chosen between a maximum and minimum, in relation to the aesthetic characteristics to be obtained.

Moreover, the machine allows to crumple a sewing edge, in particular the edge of the upper.

It is to be pointed out that the above mentioned operation is carried out in a simple way during a normal sewing cycle of the machine, without changing working periods and functionality of this cycle.

Therefore, it is not necessary to form the camber as previously described, i.e. forming the shoe front part in the shape of a dome.

Obviously, it is possible to produce also footwear without crumpling along the upper edge, according to the requested model.

I claim:

1. A method for sewing various kinds of articles made of leather, which comprises:

positioning one edge of a first article and one edge of a second article to be sewn together against respective flat side surfaces of a longitudinal guiding plate formed at the top of a ring-like block, which is rotatable on a pin that is supported, with a horizontal axis perpendicular to said guiding plate, by a free end of an arm that is swingable with respect to a stationary support frame;

sewing said edges of said articles together by an arc-shaped needle that is reciprocable on a plane transverse to said guiding plate, between a retracted position, in which the needle is located beside one of said flat side surfaces, and a piercing position, in which the needle pierces said articles, said needle being movable forward and backward;

swinging said arm while sewing the two articles together so that a spatial attitude of said guiding plate is kept unchanged as the sewing progresses.

2. A machine for sewing various kinds of articles made of leather, which comprises;

a longitudinal guiding plate, which defines two opposite flat side surfaces, said articles being positioned each one against a respective surface while said articles are movable forward, said guiding plate having a shoulder for abutment thereon of a first article of said articles;

an arc-like needle, which is reciprocable on a plane that is transverse to said guiding plate, between a retracted position, in which the needle is located beside one of said flat side surfaces and a piercing position, in which the needle pierces said articles, said needle being moved forward and backward;

a rotary hook assembly located beside the other one of said flat side surfaces for cooperation with said needle to form the stitches;

a mechanism movable in a direction transversal to said guiding plate to abut on and clamp said articles during needle piercing and retraction respectively;

a ring-like block having a top which carries said guiding plate said block being rotatable supported by a horizontal pin transverse to said guiding plate and fastened to a free end of an oscillating arm which swings with respect to a stationary frame;

a device for maintaining the spatial attitude of said guiding plate unchanged when said oscillating arm swings.

3. A machine as in claim 2, wherein said flat surfaces of said guiding plate (7) are substantially vertical and define respective working planes on which edges of said articles (8,9) to be sewn together rest.

4. A machine as in claim 2, which comprises:

a toothing positioned along the outer surface of said ring-like block;

a worm screw supported by said oscillating arm and in mesh engagement with said toothing, said worm screw being connected to said attitude maintaining device;

a transmission provided for coupling said worm screw to a ring gear sector fastened to said stationary frame and which lies on a vertical plane parallel to said guiding plate;

a pivot that is concentric with said ring gear sector;

a swing support mounted on said pivot sector and driven by a motor, said support supporting said oscillating arm.

5. A machine as in claim 2, which comprises a crumpling group situated beside a flat side surface of said longitudinal guiding plate opposite said rotary hook assembly and equipped with a head which is reciprocable backward and forward in a direction transverse to the guiding plate, so as to clamp an edge of a second article, and in a direction longitudinal to the guiding plate, to form a crumpled position in said edge of said article.

6. A machine as in claim 2, which comprises a presser foot located beside a flat surface of said longitudinal guiding plate facing said rotary hook assembly and moved in direction transverse to said guiding plate so as to clamp said articles while the needle is piercing said articles, said presser foot having a through-hole, through which said needle passes freely in a direction longitudinal to said guiding plate in synchronism with said movement of said needle.

7. A machine as in claim 2, which comprises a leather pressing element, situated beside said flat side surface of said longitudinal guiding plate opposite said rotary hook assembly and movable in direction transverse to said guiding plate so as to clamp said articles after each stitch has been performed, while the needle is being extracted and also during a return axial stroke of said needle.

8. A machine as in claim 2, which comprises a rim presser positioned over said guiding plate and vertically adjustable for acting on the edges of said articles to be sewn by a shaped head defining a cavity turned toward said articles.

9. A machine as in claim 8, wherein said shaped head of the rim presser includes two elements that act on said articles respectively, and are adjustable independently from each other for defining mutual positioning of said articles.

10. A machine as in claim 2, wherein said arc-like needle and said rotary hook assembly are supported by a head that is inclined so as to determine different working paths for said needle.

* * * * *